US008127403B2

(12) United States Patent
Leder et al.

(10) Patent No.: US 8,127,403 B2
(45) Date of Patent: Mar. 6, 2012

(54) CARD FLAT BAR FOR A CARDING MACHINE, FOR COTTON, SYNTHETIC FIBERS OR THE LIKE, HAVING A CARD FLAT CLOTHING

(75) Inventors: Armin Leder, Moenchengladbach (DE); Andreas Ebenhoeh, Moenchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 85 days.

(21) Appl. No.: 12/714,123

(22) Filed: Feb. 26, 2010

(65) Prior Publication Data

US 2010/0236025 A1 Sep. 23, 2010

(30) Foreign Application Priority Data

Mar. 18, 2009 (DE) ..... 10 2009 013 412

(51) Int. Cl.
*D01G 15/12* (2006.01)

(52) U.S. Cl. ..... 19/113

(58) Field of Classification Search ..... 19/113, 19/114

See application file for complete search history.

(56) References Cited

U.S. PATENT DOCUMENTS 4,221,023 A * 9/1980 Henderson et al. ..... 19/113

(Continued)

FOREIGN PATENT DOCUMENTS

DE 10 2004 033 059 A1 3/2005
DE 10 2006 005 605 A1 1/2007

OTHER PUBLICATIONS

German Patent and Trademark Office Search Report dated Mar. 31, 2010 with English translation.

*Primary Examiner* — Shaun R Hurley
(74) *Attorney, Agent, or Firm* — Venable LLP; Robert Kinberg; Leigh D. Thelen

(57) ABSTRACT

In a card flat bar having a card flat clothing, the card flat clothing is magnetically attached to the card flat bar body and, in use, lies opposite a clothed roller. In order to hold the clothing element against the card flat bar in a structurally simple way in the event of an increase in force on the clothing, especially to prevent the card flat clothing from making contact with the cylinder clothing, and to allow quick replacement of the card flat clothing strip, on the fibre material inlet side of the card flat clothing—seen in the direction of rotation of the roller—there is associated with the card flat bar a counter-bearing, stop or the like with which a base of the clothing co-operates in the direction towards the cylinder.

20 Claims, 9 Drawing Sheets

U.S. PATENT DOCUMENTS

| | | | | |
|---|---|---|---|---|
| 4,528,724 | A * | 7/1985 | Bisquolm | 19/113 |
| 5,467,505 | A * | 11/1995 | Graf | 19/114 |
| 7,076,839 | B2 * | 7/2006 | Schurenkramer et al. | 19/102 |
| 2001/0018781 | A1 * | 9/2001 | Wurst | 19/113 |
| 2005/0044667 | A1 * | 3/2005 | Elsasser et al. | 19/98 |
| 2007/0006424 | A1 * | 1/2007 | Landmesser | 19/145.7 |
| 2007/0186386 | A1 * | 8/2007 | Landmesser | 19/114 |

* cited by examiner

CARD FLAT BAR FOR A CARDING MACHINE, FOR COTTON, SYNTHETIC FIBERS OR THE LIKE, HAVING A CARD FLAT CLOTHING

CROSS REFERENCE TO RELATED APPLICATION

The present application claims priority from German Patent Application No. 10 2009 013 412.3 dated Mar. 18, 2009, the entire disclosure of which is incorporated herein by reference.

BACKGROUND OF THE INVENTION

The invention relates to an apparatus on a carding machine for cotton, synthetic fibres and the like, in which there is at least one card flat bar having a card flat clothing.

It is known in a card flat bar for the card flat clothing, preferably wire hooks, to be arranged in a strip-like support layer, the clothing being attached to the card flat bar and lying opposite the clothing of a roller, for example the cylinder, and at least the regions of the card flat clothing that face the card flat bar comprising an iron material, especially of steel, with at least one magnetic means (element) being provided between the card flat bar and the regions of the card flat clothing that face the card flat bar.

The revolving card top of a carding machine is the crucial technological element for reducing the number of neps in the fibre material, for example, cotton, in its most highly opened state. In its interaction with the cylinder, the revolving card top loosens the fibre knots, it being necessary for the spacing to be as small as possible but for mutual contact between the clothings to be prevented. Contact results in unnecessary wear. Premature wear in turn results in a reduction in quality. The flexible revolving card top is also the only element which can be set to extremely narrow carding nips without significant adverse technological secondary effects.

In order reliably to manage extremely narrow carding nips, precision components are a prerequisite. The revolving card flats used simultaneously on a machine are referred to as a card flat set. The differences in dimensions from card flat to card flat in the card flat set should be as small as possible. Likewise, each individual card flat should have a high degree of evenness across the width of the machine. Because increased precision is always associated with increased cost, it is necessary to combine increased precision with optimum handling at an acceptable cost. In practice, the clothings are clipped onto the card flats using enormous forces. The clipping-on operation, which has to be made reversible for re-clothing, has an adverse effect on precision and is not possible without destruction of the clothing.

In a known apparatus (DE 10 2006 005 605 A), the card flat clothing is adhesively bonded, in a tolerance compensating manner, to a metal backing sheet and is held in the revolving card top by a planar magnetic strip. The magnetic strip itself is in turn adhesively bonded, in a tolerance compensating manner, to the card flat bar. The magnetic force absorbs the process forces during the carding process with a high degree of reliability. As a result, many of the disadvantages of the old clip-on card flat system have been eliminated. The card flat sets have a high degree of precision even without an additional grinding process. Handling during re-clothing is optimum, because the clothing can be demounted, without being destroyed, using a single movement. The new clothing can be inserted again just as quickly.

The magnetic connection is a force-based connection. If a threshold force opposite to the attractive force of the magnet is applied, the clothing strip becomes detached from the card flat bar. The threshold force is such that the normal process forces can be transmitted with a high degree of reliability. This has been demonstrated by a large number of practical tests and experiments. The "old" mounting technique using clips was an interlocking connection. That connection could be broken only by overcoming the rigidity of the component. The forces necessary for that purpose are in turn a multiple greater than the threshold force of the "new" magnetic connection.

If operating conditions that can be considered abnormal then arise in a carding machine, forces can develop which exceed the threshold force of the magnet but still lie significantly below the connection strength of the clip-on technique. Abnormal operating conditions arise when the nips used are too narrow; when the fibre/clothing combination has been incorrectly selected and therefore cylinders become clogged; when, as a result of fibres that are difficult to process, temperatures suddenly rise very rapidly and there is substantial contact between clothings; when operators do not recognise the abnormal operating conditions in good time and allow the machines to continue running, and so on. It can also happen that an unusually large or solid disruptive element, for example a trash particle, fibre knot or the like, projects at least partly beyond the circle of tips of the cylinder and thus exerts undesirable pressure on the forwardly arranged regions (front regions) of the clothing of at least one card flat bar. In summary, there are situations which occur extremely rarely (exceptional cases) but give rise to enormous adverse forces.

In normal operation, the magnet absorbs all the operating forces and provides for precision support. In an abnormal operating state, the interlocking connection safeguards against contact with the cylinder clothing.

SUMMARY OF THE INVENTION

It is an aim of the invention to create an apparatus which, in particular, provides a structurally simple way of holding the clothing element against the card flat bar in the event of an increase in pressure on the card flat clothing, especially of preventing the card flat clothing from making contact with the cylinder clothing, and allows quick replacement of the card flat clothing strip.

The invention provides a card flat bar for use in a carding machine opposite a clothed roller of said machine, having a card flat bar body having a material inlet side at which in use fibre material is received, and a card flat clothing strip which is magnetically attachable to the card flat bar body, wherein the card flat bar body includes a counter-bearing associated with said material inlet side and the card flat clothing strip comprises a counter-element arranged to co-operate, in use, with the counter-bearing in a direction towards said opposed clothed roller.

Because there is associated with the card flat bar, on the fibre material inlet side of the card flat clothing, a counter-bearing, stop or the like with which the base and/or the support member co-operate(s) in the direction towards the roller, for example carding cylinder, undesirable forces are compensated for. In this structurally simple way, in the event of an increase in pressure on the clothing, the clothing element is held against the card flat bar, that is to say contact between the card flat clothing and the cylinder clothing is reliably avoided even if there is local detachment from the magnet. The invention has the further substantial advantage that in the event of replacement the card flat clothing strip can be removed or inserted without problems, because there is no counter-bearing, stop or the like on the fibre material outlet side of the card flat clothing.

Advantageously, the clothing strip has a support layer and a base for attachment to the card flat bar, and the counter-element is the base. The counter-element may be, for example, a shoulder or the like on the base. In another embodiment, the counter-element may be the support layer. For example, the counter-element may be a shoulder or the like on the support layer. In certain embodiments the base or the support layer co-operates with the card flat bar by means of an interlocking connection. The counter-bearing may be in any suitable form. Illustrative arrangements for the counter-bearing include those in which the counter-bearing is a shaped portion of the foot of the card flat bar body, for example, an angled edge on the card flat foot, an undercut, a nose, an angled side on the card flat foot, or a groove in the card flat foot; and arrangements in which a bearing element is inserted into or attached to the foot of the card flat body, for example, a bent-over sheet metal element or the like, a screw, a bolt or the like, a resilient element, or a clip-like element. In the case of a groove, the base of the clothing , advantageously projects into the groove. Advantageously, the base projects beyond the support layer of the clothing. The counter-bearing may extend under the base or the support layer of the clothing at a spacing of about from 1 to 3 mm. Advantageously, the counter-bearing, for example the stop, is present at least partially along the longitudinal edge of the card flat foot on the fibre material inlet side. Advantageously, there is a spacing (play) between the upper side of the counter-bearing and the underside of the base or support layer. Advantageously, during normal carding conditions, the spacing (play) is smaller than the spacing between the card flat clothing and the clothing of the cylinder (carding nip).

In some embodiments, there is a counter-bearing in the region of each of the two end faces of the card flat foot (card flat heads). Advantageously, when the threshold force of the magnet is exceeded the clothing strip is supported on the counter-bearing. That prevents the clothing strip from contacting the opposed roller. For example, the base may be supported on the counter-bearing in the event of abnormal carding conditions resulting in detachment of the clothing strip. Where the counter-element is the support layer, the support layer may be supported on the counter-bearing in the event of detachment of the carding strip.

In some embodiments, magnetic means are attached to the card flat bar, for example, by means of an adhesive layer or the like, or by means of a screw connection or the like. In some embodiments, the magnetic means consists of a permanently magnetic material. It will be appreciated that, under normal carding conditions, the magnetic force is greater than other forces acting on the clothing, for example carding force, force of a rotating cleaning roller or the like. Preferably, the clothing is removable from the magnetic means. Preferably, the clothing is joined to the card flat bar by means of the magnetic means as attachment element. Preferably, the clothing is removably detachable from the magnetic means. In one preferred embodiment, the clothing, which is inserted into a substrate, for example fabric or the like, consists of wires or the like which are bent into approximately a U-shape and inserted in such a way that the crosspiece of the U-shaped wires or the like runs on the rear side of the substrate. Preferably, between the card flat bar and the card flat clothing there is a compensating layer which is able to compensate for the different spacings between the card flat bar and the card flat clothing. In certain embodiments, an adhesive layer is provided. The clothing is preferably a clothing strip. In certain embodiments, the card flat bar comprises a neodymium magnet. In certain advantageous forms of clothing, a thin metal support is advantageously provided. Advantageously, the clothing is a flexible clothing. Preferably, the flexible clothing comprises a support and clothing tips, wires, hooks or the like. Preferably, the support is strip-shaped. In other embodiments, the clothing consists of sawtooth wire strips, for example all-steel clothing.

Advantageously, the clothing is attached to the card flat bar in the region of the foot surface. Advantageously, a plastics material, a synthetic resin, for example epoxy resin, or the like, is provided as compensating composition. Preferably, the card flat bar is an extruded profile made from a lightweight metal, for example aluminium. Preferably, the extruded profile is a hollow profile. Preferably, the card flat bar comprises a supporting member, with which are associated two end head parts (card flat heads). Preferably, the end head parts are pins made of hardened steel or the like. Preferably, a supporting element of the clothing (for example, of textile material) and the compensating layer are arranged in a recess in the foot face (supporting member). Preferably, the recess is defined by at least two lateral ribs or the like on the longitudinal sides of the supporting member of the card flat bar. In some embodiments, the underside of the clothing strip against which the backs of bent wires of the clothing are located is held by means of a magnet fixed to the card flat bar. In certain embodiments, a clothing strip is included, to which there is additionally attached, by way of a compensating adhesive layer, a metal sheet which is brought into connection with the magnet of the card flat bar. In preferred embodiments of the invention, a vertical linkage on the fibre material inlet side is supported mechanically.

Advantageously, the magnetic means comprises an elongate magnetic element, for example magnetic tape, magnetic strip, magnetic bar or the like, that runs in the longitudinal direction of the card flat bar. In some embodiments, a plurality of magnetic elements are present in the longitudinal direction of the card flat bar. Preferably, the magnetic elements are arranged spaced apart from one another. In certain embodiments, the magnetic structural elements are arranged offset with respect to one another. Preferably, the offset runs in the working direction. In certain embodiments, a base made of a magnetic material is arranged on the rear side of the card flat clothing. Advantageously, the base is a steel tape, metal sheet or the like. Advantageously, the base has, on the fibre material inlet side, shoulders, ribs or the like which are bent at an angle at the side.

In some embodiments, the card flat clothing has at least two clothing groups which are each held by a magnet. For example, there may be at least two clothing groups each having a heel zone opposite the roller clothing. In certain embodiments the card flat clothing consists of a multiplicity of all-steel clothing wires which are arranged in the axial direction with respect to the clothed roller, for example the cylinder. Preferably, the card flat clothing is held against the card flat bar by at least, one magnetic element.

In certain preferred embodiments, magnetic means is integrated into the card flat bar. Advantageously, a base made of a fine material is provided on the rear side of the card flat clothing. In one advantageous embodiment, magnetic means is formed with the card flat bar by casting. In another advantageous embodiment, the magnetic means is incorporated into the card flat bar by casting or compression moulding. Advantageously, the magnetic means is simultaneously incorporated during the manufacture of the card flat bar. In one advantageous embodiment, at least one and preferably each of the marginal regions bordering the longitudinal edges is provided with tips. Advantageously, the magnetic element is at least partly in contact with the sheet-form metal support of the clothing.

The invention also provides a card flat bar for a carding machine for cotton, synthetic fibres and the like, having a card flat clothing, wherein the card flat clothing, preferably wire hooks, which is arranged in a strip-shaped support layer, is attached to the card flat bar and at least the regions of the card flat clothing that face the card flat bar consist of an iron material, especially of steel, with at least one magnetic means being provided between the card flat bar and the regions of the card flat clothing that face the card flat bar, wherein on the fibre material inlet side of the card flat clothing—seen in the direction of rotation of the cylinder—there is associated with the card flat bar a counter-bearing, stop or the like with which the base co-operates in the direction towards the cylinder.

Further, the invention provides a flexible clothing for a card flat bar on a carding machine for cotton, synthetic fibres and the like, having a card flat clothing, wherein the card flat clothing, preferably wire hooks, which is arranged in a strip-shaped support layer, is attachable to the card flat bar and at least the regions of the card flat clothing that are arranged to face the card flat bar consist of an iron material, especially of steel, wherein on the fibre material inlet side of the card flat clothing—seen in the direction of rotation of the cylinder—there is associated with the card flat bar a counter-bearing, stop or the like with which the base co-operates in the direction towards the cylinder.

Moreover, the invention provides a carding machine having a revolving card flat assembly for cotton, synthetic fibres and the like, in which there is at least one card flat bar having a card flat clothing, wherein the card flat clothing, preferably wire hooks, which is arranged in a strip-shaped support layer, is attached to the card flat bar and lies opposite the clothing of a roller, for example the cylinder, and at least the regions of the card flat clothing that face the card flat bar are provided with at least one magnetic element wherein on the fibre material inlet side of the card flat clothing—seen in the direction of rotation of the cylinder—there is associated with the card flat bar a counter-bearing, stop or the like with which the base co-operates in the direction towards the cylinder.

The invention also provides an apparatus on a carding machine for cotton, synthetic fibres and the like, in which there is at least one card flat bar having a card flat clothing, wherein the card flat clothing, preferably wire hooks, which is arranged in a strip-like support layer, is attached to the card flat bar and lies opposite the clothing of a roller; for example the cylinder, and at least the regions of the card flat clothing that face the card flat bar consist of an iron material, especially of steel, with at least one magnetic means (element) being provided between the card flat bar and the regions of the card flat clothing that face the card flat bar, wherein on the fibre material inlet side of the card flat clothing—seen in the direction of rotation of the cylinder—there is associated with the card flat bar a counter-bearing, stop or the like with which a counter-element associated with the card flat clothing co-operates in the direction towards the cylinder.

DETAILED DESCRIPTION OF PREFERRED EMBODIMENTS

Figure 1:
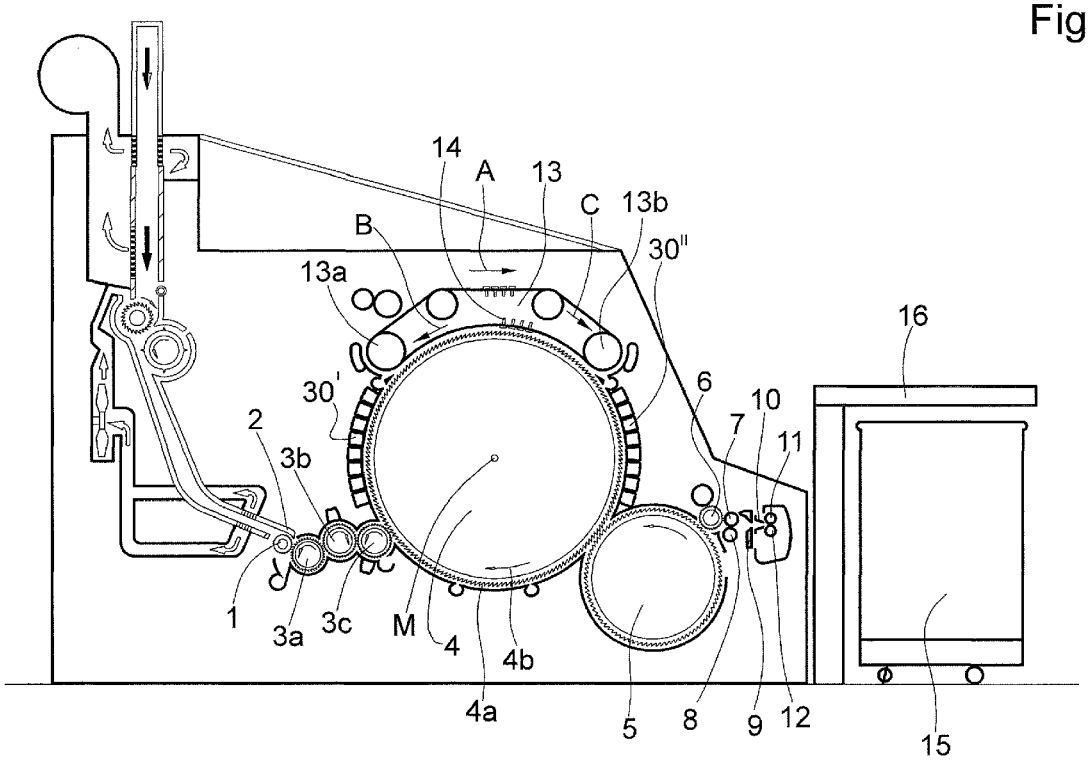
FIG. 1 is a diagrammatic side view of a carding machine having a revolving card top with card flat bars according to a first embodiment of the invention.

With reference to FIG. 1, a carding machine, for example a flat card TC 07 (trademark) made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web guide element 9, web funnel 10, delivery rollers 11, 12, revolving card top 13 with card top guide rollers 13*a*, 13*b* and card flat bars 14, can 15 and coiler 16. The directions of rotation of the rollers are indicated by curved arrows. Reference letter M denotes the centre point (axis) of the cylinder 4. Reference numeral 4*a* denotes the clothing and reference numeral 4*b* denotes the direction of rotation of the cylinder 4. Reference letter B denotes the direction of rotation of the revolving card top 13 in the carding position and reference letter C denotes the return transport direction of the card flat bars 14, with reference numerals 30', 30" denoting functional elements and reference numerals 13*a* and 13*b* denoting card top guide rollers. The arrow A denotes the working direction.

Figure 2:
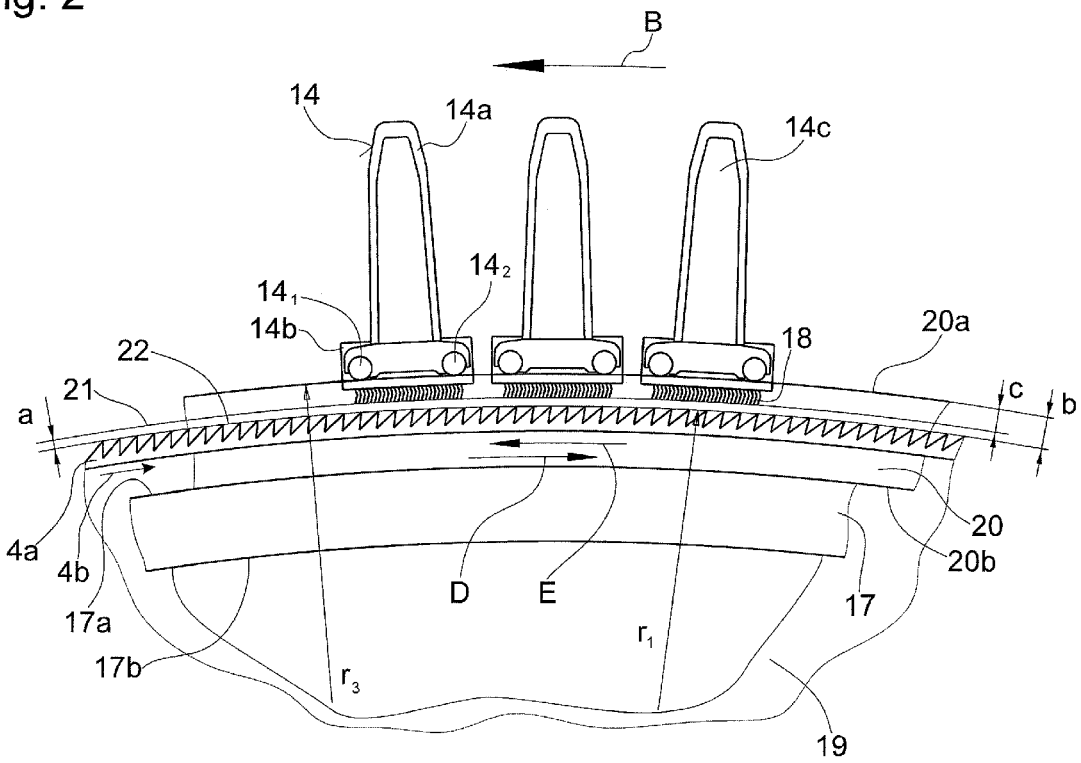
FIG. 2 shows card flat bars of the revolving card top and a portion of a slideway, of a setting bend (flexible bend) having a side screen and of the cylinder, as well as showing the carding nip between the clothings of the card flat bars and the cylinder clothing.

In accordance with FIG. 2, on each side of the carding machine there is provided a setting bend 17 (flexible bend) which is integrated integrally into the associated side screen 19. The setting bend 17 has a convex outer surface 17*a* and an underside 17*b*. On top of the setting bend 17 there is a slideway 20, for example made of low-friction plastics material, which has a convex outer surface 20*a* and a concave inner surface 20*b*. The concave inner surface 20*b* rests on top of the convex outer surface 17*a* and is able to slide thereon in the direction of arrows D, E. Each card flat bar 14 consists of a rear part 14*a* and a card flat foot 14*b*. Each card flat bar 14 has, at each of its two ends, a card flat head, each of which comprises two steel pins $14_1$, $14_2$. Those portions of the steel pins $14_1$, $14_2$ that extend out beyond the end faces of the card flat foot 14*b* slide on the convex outer surface 20*a* of the slideway 20 in the direction of the arrow B. A clothing 18 is attached to the underside of the card flat foot 14*b*. Reference numeral 21 denotes the circle of tips of the card flat clothings 18. The cylinder 4 has on its circumference a cylinder clothing 4*a*, for example a sawtooth clothing. The tooth height of the sawteeth is, for example, h=2 mm. Reference numeral 22 denotes the circle of the tips of the cylinder clothing 4*a*. The spacing (carding nip) between the circle of tips 21 and the circle of tips 22 is denoted by reference letter a and is, for example, 3/1000". The spacing between the convex outer surface 20*a* and the circle of tips 22 is denoted by reference letter b. The spacing between the convex outer surface 20*a* and the circle of tips 21 is denoted by reference letter c. The radius of the convex outer. surface 20*a* is denoted by reference letter $r_3$ and the radius of the circle of tips 22 is denoted by reference letter $r_1$. The radii $r_1$ and $r_3$ intersect at the centre point M of the cylinder 4. Reference numeral 19 denotes the side screen. The card flat bars 14 are extruded hollow profiles made of aluminium having an internal cavity 14*c*.

Figure 3A:
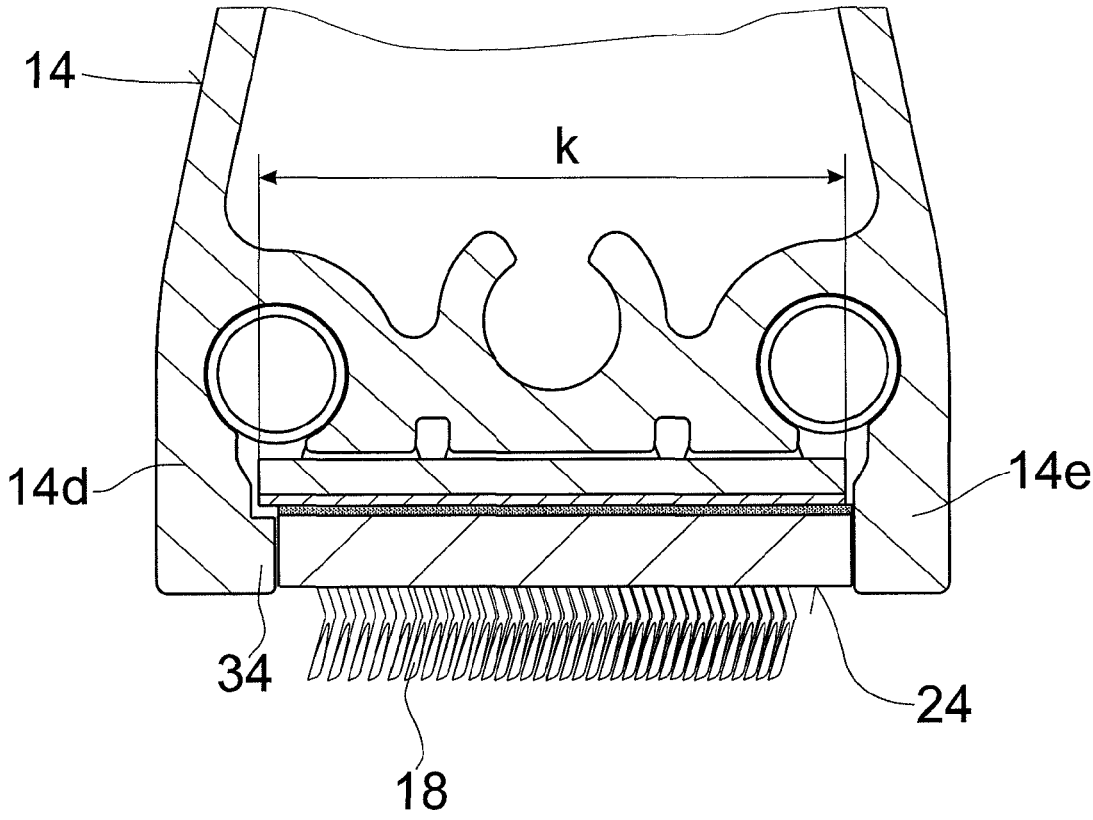
FIG. 3*a* is a side view in section through a portion of a card flat bar with a counter-bearing and with magnetic strip and clothing strip (wire hook clothing) in the assembled position.
Figure 3B:
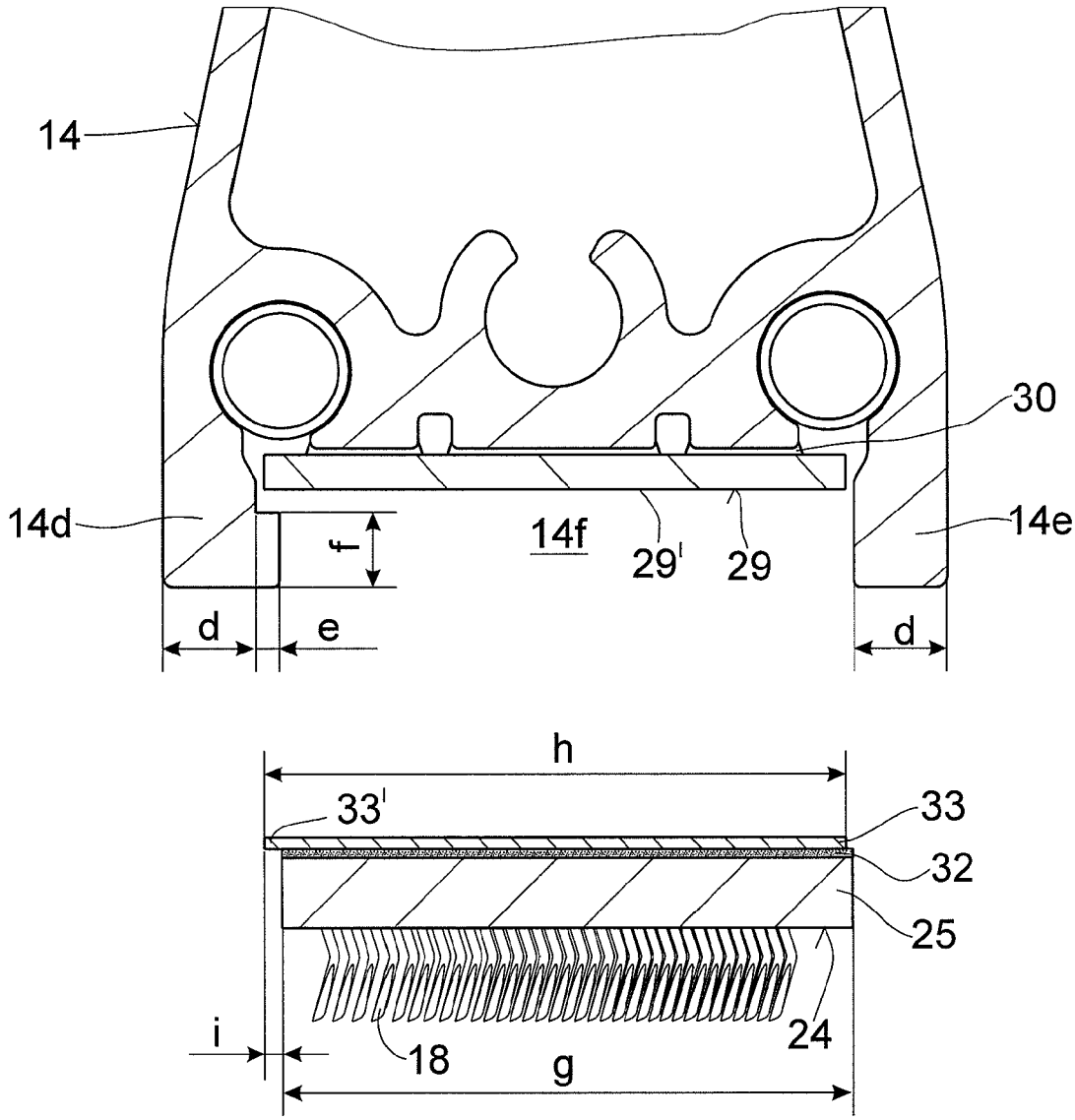
FIG. 3*b* shows the card flat bar with counter-bearing and magnetic strip in accordance with FIG. 3*a*, but with a separately detached clothing strip.

FIGS. 3*a* and 3*b* show a first embodiment of card flat bar according to the invention. The card flat clothing 24 consists of clothing tips 18 (wire hooks) and a supporting element 25 (support layer) made of a textile material. The wire hooks 18 are approximately U-shaped and, punched through the surface 25', are fixed in the supporting element 25. The turn regions 18' (see FIG. 4) of the wire hooks 18 project beyond the surface 25'. The ends of the wire hooks 18, the clothing tips, are free. The wire hooks 18 consist of steel wire.

Two ribs 14*d*, 14*e* are provided laterally on the card flat foot 14*a* in the longitudinal direction, so that in the region of the foot face there is a recess 14*f*, by means of which the card flat clothing 24 is held, protected and embedded. In the recess 14*f* there is arranged a magnetic element 29, for example a magnetic tape, magnetic strip, magnetic bar or the like, which is attached to the foot face by means of an adhesive layer 30. The magnetic element can also be formed on the card flat bar by casting, compression moulding or the like, for example magnetic powder with a curable resin. The magnetic element is advantageously a permanent magnet, for example a neodymium magnet. In the lower recess 14*f* there is arranged the card flat clothing 24. The card flat clothing 24 is attached to, i.e. held against, the magnetic element 29 by its region remote from the free clothing tips 18 (teeth).

In the arrangement shown in FIGS. 3*a* and 3*b*, the card flat clothing 24 (clothing strip) consists of wire hooks 18 and supporting element 25. The arrangement additionally has a compensating layer 32 which enables card flat precision to be improved and the attachment surface area to be enlarged. The compensating layer 32 is advantageously an adhesive layer to which there is attached a metal sheet 33 (base) or the like, for example a steel sheet, which is in contact with the magnet 29.

FIG. 3*a* shows the card flat bar 14 and the card flat clothing 24 in the assembled state, the card flat clothing 24 being held so securely by the magnet 29 by way of the steel sheet 33 that, during operation, forces acting through the carding machine on the card flat clothing 24 hold the card flat clothing 24 against the magnet 29. According to FIG. 3*b*, the card flat clothing 24 has, for example in the event of wear, damage or the like to the clothing hooks 18 including the base 33, been separated from the magnet 29 and removed from the recess 14*f*. Separation from the magnet 29 can be effected by means of a suitable tool with which the holding force of the magnet is overcome. The separation can be effected manually even while the carding machine is running, during operation, on the return transport of the card flat bars 14 (see arrow C in FIG. 1). The card flat bars 14 are removable from the toothed drive belt (not shown).

In the card flat bar of FIG. 3*a*, 3*b*, on the fibre material inlet side ES of the clothing 18—seen in the direction of rotation 4*a* of the cylinder 4 (see FIG. 1)—a counter-bearing 34 is present only on the rib 14*d*. The counter-bearing 34, which projects into the recess 14*f* in the form of a shoulder on the rib 14*d*, is formed in one piece with the rib 14*d* during the extrusion of the card flat bar 14. In this arrangement, rib 14*d* and counter-bearing 34 are merged integrally in one piece. The width of the rib 14*d* is denoted by reference letter d. According to FIG. 3*b*, the counter-bearing 34 has a width e and a height f. The width e is about from 1 to 3 mm and projects beyond the width d. The length l (not shown) of the counter-bearing 34 corresponds to the working width of the card flat bar 14 across the cylinder 4 and can be, for example, 1000 mm, 1200 mm or 1500 mm or more. The counter-bearing 34 can be of one-part or multi-part construction in the longitudinal direction.

In the embodiment of FIG. 3*b*, the supporting element 25 has a width g. The width of the adhesive layer 32 corresponds to the width g of the supporting element 25. The width h of the sheet metal strip 33 is greater than the width g of the supporting element 25. In that way, the edge region 33' of the sheet metal strip 33 on the fibre material inlet side ES of the clothing 18 projects beyond the supporting element 25 by amount i. As shown in FIG.3*a*, reference letter k denotes the width of the magnetic element 29.

Figure 4:
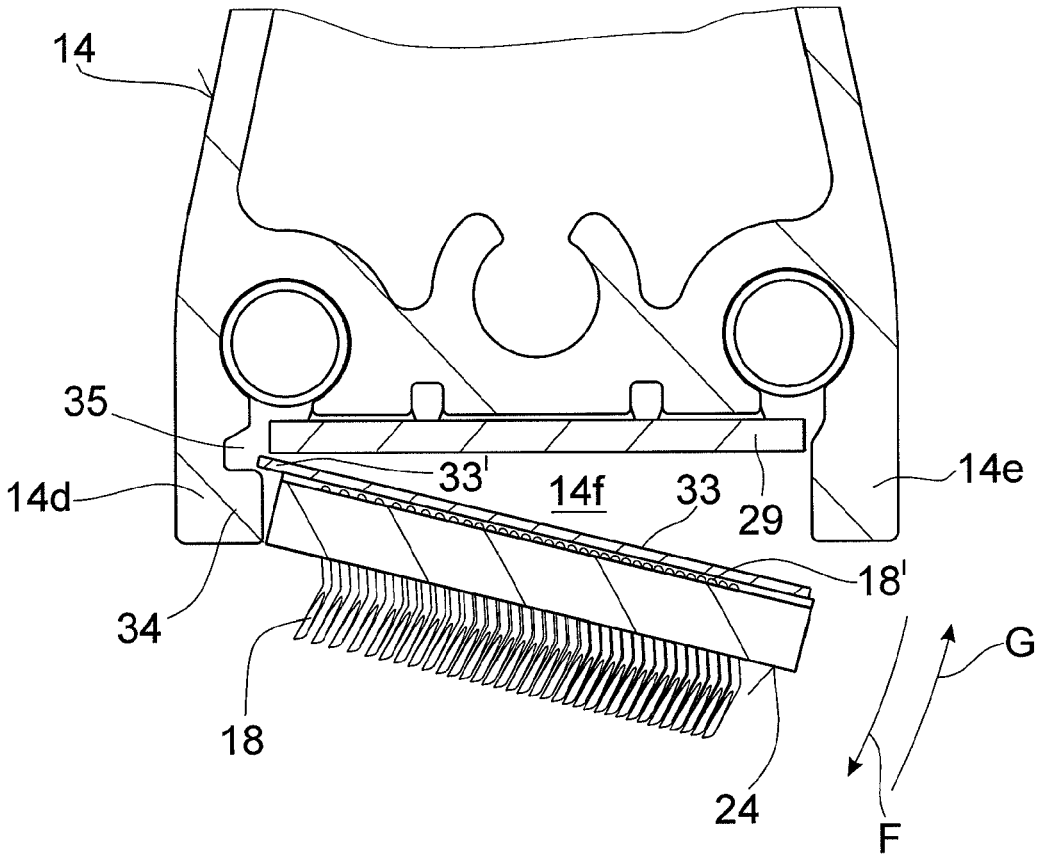
FIG. 4 is a side view in section of a further card flat bar according to the invention, showing diagrammatically the installation of the clothing strip in the card flat foot of the card flat bar or the demounting of the clothing strip therefrom.

FIG. 4 shows diagrammatically the installation of the clothing strip 24 in the card flat foot 14*b* of the card flat bar 14 and the demounting of the clothing strip therefrom. Because the rib 14*e* is not associated with a counter-bearing, stop or the like, the clothing strip 24, for example having a worn or damaged clothing 18, can —after separation of the sheet metal strip 33 from the magnetic element 29—be rotated clockwise in the direction of arrow F out of the recess 14*f*. The edge region 33' of the sheet metal strip 33 that projects by amount i (see FIG. 3*b*) is rotated about the upper edge region of the counter-bearing 34 in direction F, the edge region 33' at the same time being withdrawn from a groove 35 in the rib 14*d*, which groove runs in the longitudinal direction l of the card flat bar 14. A new clothing strip 24 is installed in the card flat foot 14*b* of the card flat bar 14 in a corresponding way. First the edge region 33' is introduced, around the upper edge region of the counter-bearing 34, into the groove 35, so that the clothing strip 24 is rotated anti-clockwise in the direction of arrow G until the sheet metal strip 33 adheres firmly to the magnetic element 29. In that way, handling during installation and demounting of the clothing strip is problem-free.

Figure 5:
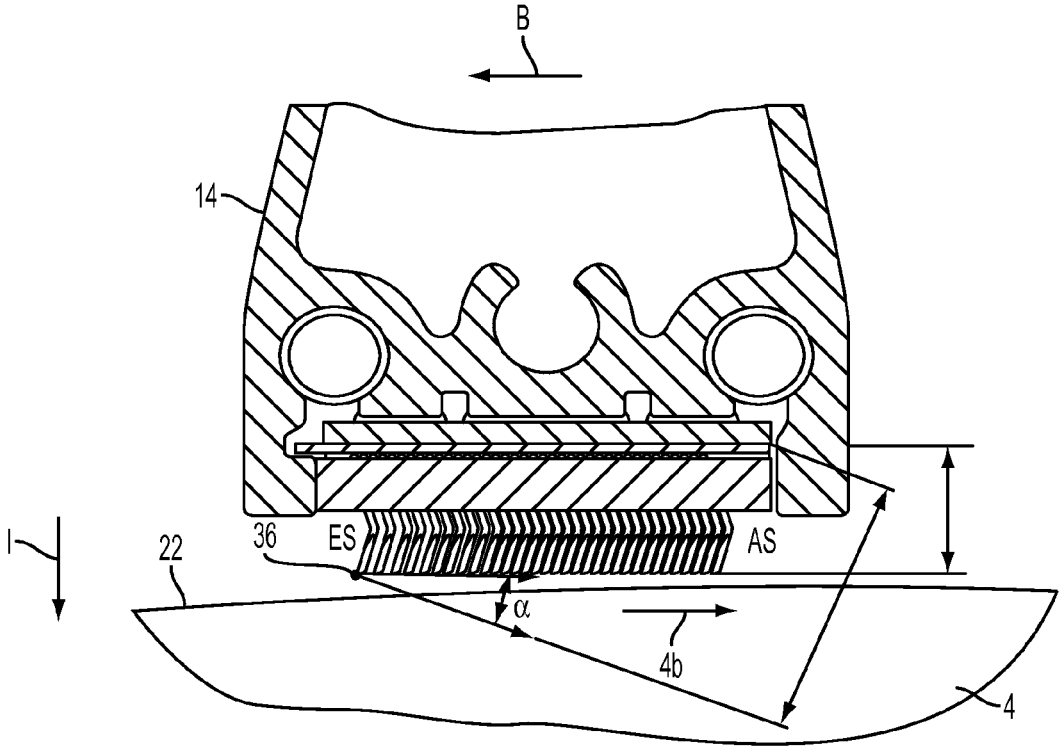
FIG. 5 shows the force application point and the angle of application with respect to the card flat clothing on the fibre material inlet side.

By way of illustration with reference to a card top bar according to FIG. 4, FIG. 5 shows, by the force application point 36 and the angle of application a on the fibre material inlet side ES. Reference letters AS denote the fibre material outlet side. The force that arises in any particular case can vary greatly in magnitude but the force application point 36 and the application angle a is limited. It is therefore possible to create geometric conditions which absorb the forces through an interlocking connection. FIG. 5 shows an exemplary configuration of such an interlocking connection. It will be apparent from, for example, the illustrative embodiment of FIGS. 4 and 5 that the counter-bearing provided, in accordance with the invention, presents on obstacle to removal of the clothing strip in the direction towards the roller, during use, at the position most prone to abnormal carding conditions, that is at the material inlet side of the card flat. On the other hand, the counter-bearing does not impede removal of the strip when desired (see, for example, FIG. 4).

Reference letter 4*b* denotes the direction of rotation of the cylinder (flow of fibre material). The angle of application a represents a possible variation of the direction of application of the threshold force. The curved arrow I indicates the direction in which in an abnormal operating state, that is to say in the event of the limit force being exceeded, the clothing strip 24 is rotated minimally about a pivot point in the region of the rib 14*e* (see FIG. 6*b*).

Figure 6A:
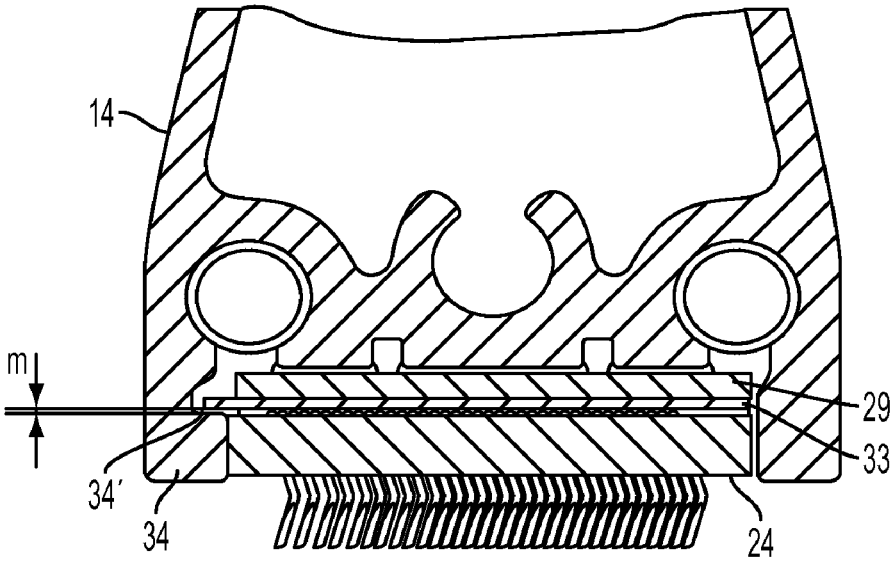
FIG. 6*a* shows on the fibre material inlet side of a card flat bar according to FIG. 4, a spacing between the underside of a shoulder of the base and the counter-bearing.
Figure 6B:
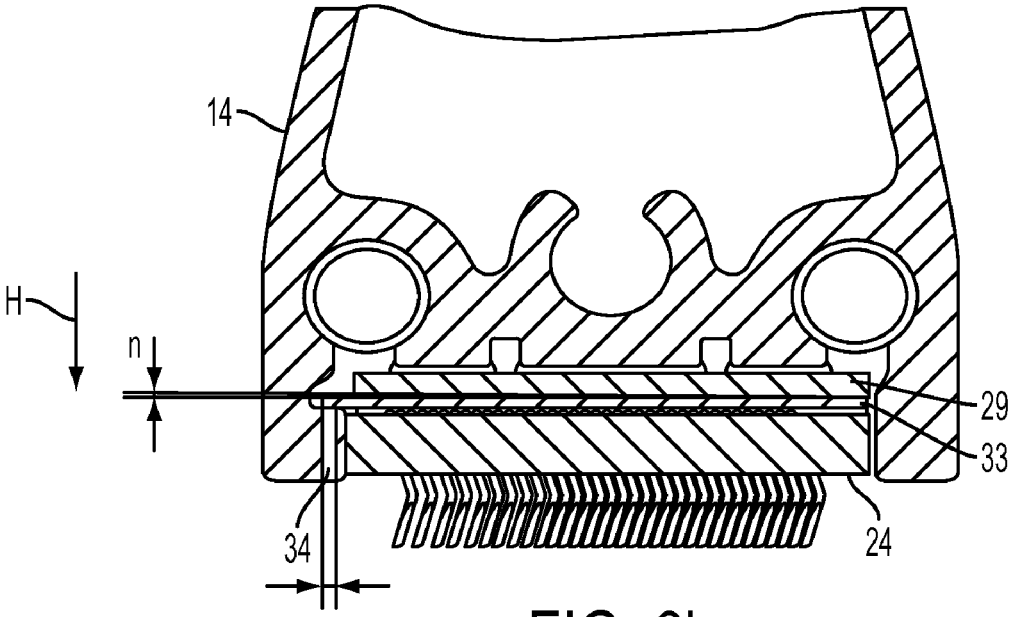
FIG. 6*b* shows the card flat bar according to FIG. 4 with a spacing between the upper side of the base and the magnet

In accordance with FIG. 6*a*, on the fibre material inlet side ES there is a spacing m between the underside of the sheet metal strip 33 serving as base and the upper side 34' of the counter-bearing, 34. FIG. 6*a* represents the normal operating state. According to FIG. 6*b*, on the fibre material inlet side ES there is a spacing n between the upper side 33' (see FIG. 3*b*) of the sheet metal strip 33 serving as base and the underside 29' (see FIG. 3*b*) of the magnetic element 29. FIG. 6*b* represents the abnormal operating state. Whereas during normal operation in accordance with FIG. 6*a* there is no contact between the marginal regions 33' of the sheet metal strip 33 and the counter-bearing 34, in the abnormal operating state according to FIG. 6*b* the marginal region 33' of the sheet metal strip 33 is supported by, i.e. presses against, the counter-bearing 34 in direction H.

In order that handling during mounting is not appreciably limited, the interlocking connection must be designed to have some play. The spacing m in accordance with FIG. 6*a* allows for play. In a case of abnormal operation in which the limit force of the magnet 29 is overcome, the clothing strip 24 together with its metal backing sheet 33 tilts away from the planar magnetic surface 29' (arrow H in FIG. 6*b*) and is supported on the counter-bearing 34 (aluminium edge) of the card flat bar.

The clearance m is significantly smaller than the spacing a (see FIG. 2) between the card flat clothing 18 and the cylinder clothing 4*a*, so that there is no risk of contact.

In normal operation (FIG. 6*a*), the magnet 29 absorbs all the operating forces and provides for precision support. In the abnormal operating state (FIG. 6*b*), the interlocking connection safeguards against contact between the card flat clothing 18 and the cylinder clothing 4*a*.

In another embodiment of the invention shown in

Figure 7:
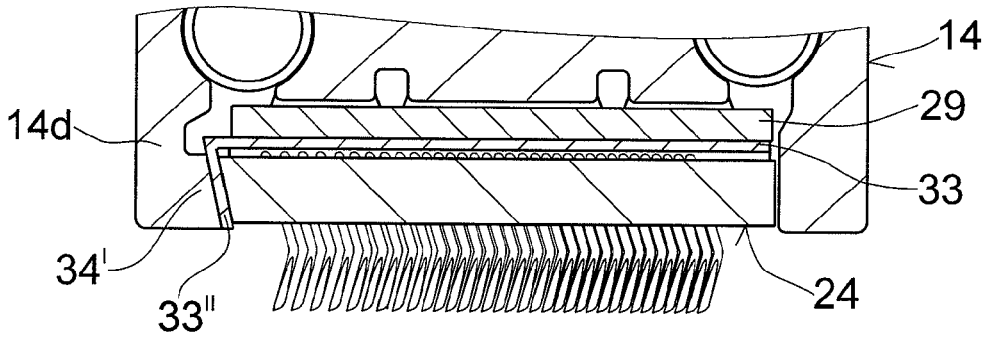
FIG. 7 shows an embodiment having an angled side on the counter-bearing and on the base.

FIG. 7, a card flat bar has an angled side on the counter-bearing 34' and an angled side 33" on the sheet metal strip 33 is provided, the respective angled sides being in interlocking engagement.

Figure 8:
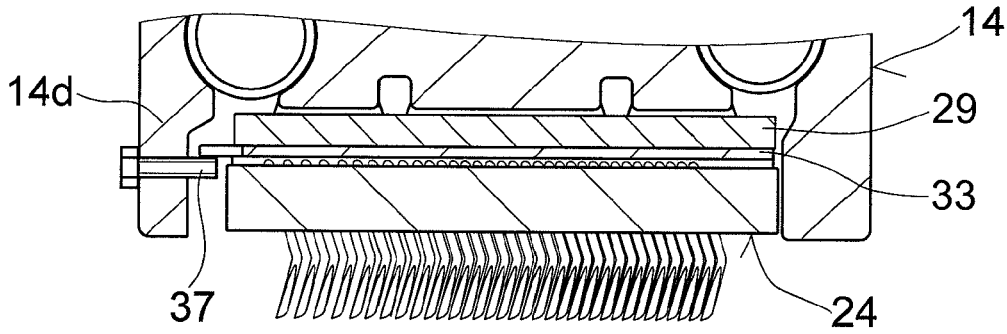
FIG. 8 shows an embodiment having a screw as counter-bearing.

In a further embodiment, shown in FIG. 8, a screw 37 passing through the rib 14*d* is provided as counter-bearing. The screw 37 is removable, and the screw 37 allows a settable depth into the recess 14*f* for the support of the edge region 33' of the sheet metal strip 33.

Figure 9:
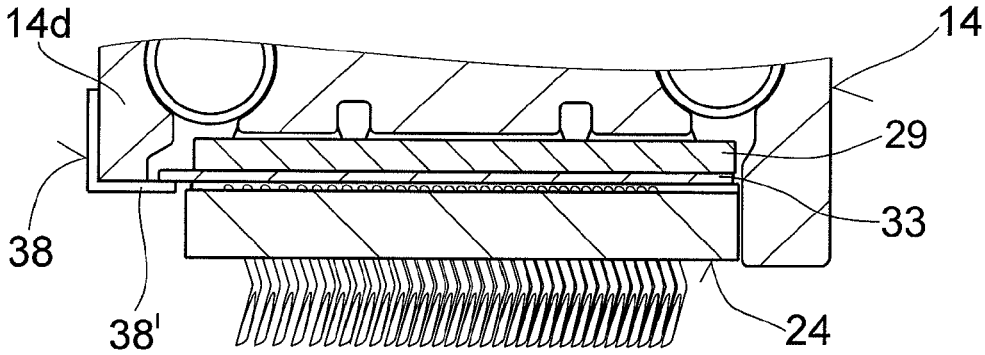
FIG. 9 shows an embodiment having a flexible metal sheet as counter-bearing.

In yet another embodiment, shown in FIG. 9, a flexible metal sheet 38 is mounted on the outside of the rib 14*d*, the limb 38' of which, bent over, serves as counter-bearing.

Figure 10:
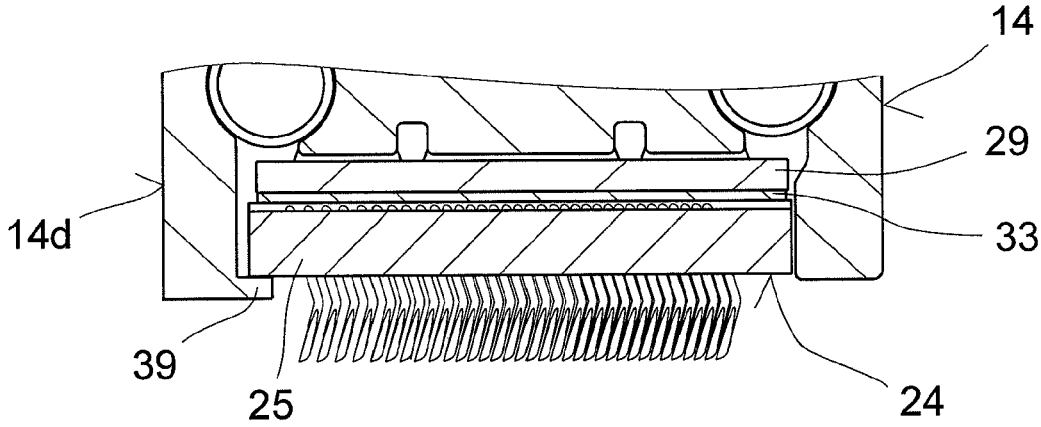
FIG. 10 shows an embodiment having a counter-bearing with which the support layer of the clothing strip co-operates.

FIG. 10 shows an embodiment in which there is a counter-bearing 39 on the rib 14*d* with which the support layer 25 of the clothing strip 24 co-operates.

Figure 11:
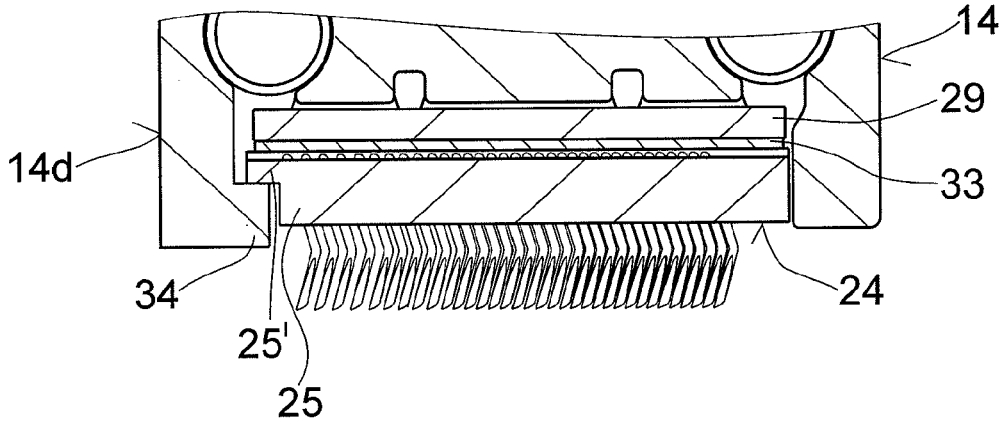
FIG. 11 shows an embodiment having a shoulder on the supporting element which co-operates with the counter-bearing.

In the embodiment of FIG. 11, a shoulder 25' is present on the supporting element 25, which shoulder co-operates with the counter-bearing 34. In this arrangement the turn regions 18' of the clothing 18 are in contact with the magnetic element 29.

The invention has been explained by way of illustration with reference to the embodiments shown. Further arrangements are included in the scope of protection. For example, in the region of the two end faces of the card flat foot 14*b* of the card flat bars 14 there can be provided, in addition or on its own, at least one counter-bearing with which a shoulder on the base 33 and/or on the support member 25 in that region co-operates. The card flat clothing can also be semi-rigid or can be in the form of all-steel clothing, for example sawtooth clothing.

Although the foregoing invention has been described in detail by way of illustration and example for purposes of understanding, it will be obvious that changes and modifications may be practised within the scope of the appended claims.

What is claimed is:

1. A card flat bar for use in a carding machine opposite a clothed roller of said machine, having a card flat bar body having a material inlet side at which in use fibre material is received, and a card flat clothing strip which is magnetically attachable to the card flat bar body, wherein the card flat bar body includes a counter-bearing associated with said material inlet side and the card flat clothing strip comprises a counter-element arranged to co-operate, in use, with the counter-bearing in a direction towards said opposed clothed roller, and wherein there is a spacing between the upper side of the counter-bearing and the underside of the counter-element, which spacing is smaller than the spacing between the card flat clothing and the clothing of the roller.

2. A card flat bar according to claim 1, in which the clothing strip has a support layer with wire hooks, and a base for attachment to the card flat bar.

3. A card flat bar according to claim 2, in which the counter-element is a shoulder on the base and/or the support layer.

4. A card flat bar according to claim 2, in which the counter-element is a portion of the support layer.

5. A card flat bar according to claim 1, in which the counter-bearing is a shaped portion of a foot region of the card flat bar body.

6. A card flat bar according to claim 1, in which the counter-bearing comprises a bearing element protruding from a foot region of the card flat bar body.

7. A card flat bar according to claim 1, in which the counter-bearing is formed by a groove in the card flat foot, and a base of the clothing strip projects into the groove.

8. A card flat bar according to claim 7, in which the clothing strip comprises a support layer for clothing hooks and a base for attaching the clothing strip to the card flat body, the base having a portion that projects beyond the support layer for insertion into the groove.

9. A card flat bar according to claim 1, in which the counter-bearing is present at least partially along the longitudinal edge of a foot region of the card flat bar body on the fibre material inlet side.

10. A card flat bar according to claim 1, in which when a threshold force of the magnet attachment is exceeded the clothing strip is supported on the counter-bearing.

11. A card flat bar for use in a carding machine opposite a clothed roller of said machine, having a card flat bar body having a material inlet side at which in use fibre material is received, and a card flat clothing strip which is magnetically attachable to the card flat bar body, wherein the card flat bar body includes a counter-bearing associated with said material inlet side and the card flat clothing strip comprises a counter-element arranged to co-operate, in use, with the counter-bearing in a direction towards said opposed clothed roller, and wherein a foot portion of the card flat bar body is magnetic or includes a magnetic element and the clothing strip comprises one or more magnetic elements for magnetic attachment of the clothing strip to the card flat bar body.

12. A card flat bar according to claim 11, in which the clothing comprises a clothing strip having a multiplicity of clothing wires so inserted therein that clothing tips of the wires are located on a front side of said clothing strip and clothing wire bases are located on a reverse side of said clothing strip, the clothing wire bases being magnetic and serving for magnetic attachment of the strip to the card flat bar body.

13. A card flat bar according to claim 11, in which the clothing comprises a magnetic base member.

14. A card flat bar for use in a carding machine opposite a clothed roller of said machine, having a card flat bar body having a material inlet side at which in use fibre material is received, and a card flat clothing strip which is magnetically attachable to the card flat bar body, wherein the card flat bar body includes a counter-bearing associated with said material inlet side and the card flat clothing strip comprises a counter-element arranged to co-operate, in use, with the counter-bearing in a direction towards said opposed clothed roller, and wherein the magnetic force is greater between the clothing strip and the card flat bar body than the forces that, in use, act on the clothing, the arrangement being such that under normal operating conditions the counter-bearing and counter-element are not in contact with one another whilst in abnormal operating conditions the removal of the clothing strip can be prevented by contact between the counter-bearing and counter-element.

15. A card flat bar according to claim 1, in which between the card flat bar body and the card flat clothing strip there is a compensating layer which is able to compensate for the different spacings between the card flat bar body and the card flat clothing.

16. A card flat bar according to claim 1, in which the clothing consists of sawtooth wire strips.

17. A card flat bar according to claim 1, in which a supporting element of the clothing strip and optionally a compensating layer are arranged in a recess in a foot face of the card top bar body, the recess being defined by at least two lateral ribs on the longitudinal sides of the card flat bar body.

18. A card flat bar according to claim 1, in which there are at least two clothing groups which are each held by a magnet, and each of which has a heel zone opposite the roller clothing.

19. A card flat bar for a carding machine for cotton, synthetic fibres and the like, opposite a clothed roller of said machine, having a card flat clothing, wherein the card flat clothing, which is arranged in a strip-shaped support layer, is attached to the card flat bar and at least the regions of the card flat clothing that face the card flat bar consist of an iron material, with at least one magnetic means being provided between the card flat bar and the regions of the card flat clothing that face the card flat bar, wherein on the fibre material inlet side of the card flat clothing—seen in the direction of rotation of the cylinder—there is associated with the card flat bar a counter-bearing, stop or the like with which the base co-operates in the direction towards the cylinder, and wherein there is a spacing between the upper side of the counter-bearing and the underside of the regions of the card flat clothing that face the card flat bar, which spacing is smaller than the spacing between the card flat clothing and the clothed roller.

20. A flexible clothing for a card flat bar on a carding machine wherein opposite a clothed roller of said machine, wherein the card flat clothing is attachable to the card flat bar and at least the regions of the card flat clothing that are arranged to face the card flat bar consist of an iron material, in which on the fibre material inlet side of the card flat clothing—seen in the direction of rotation of the cylinder—there is a counter element with which a counter-bearing of the base of the card flat bar can co-operate in the direction towards the cylinder, and wherein there is a spacing between the upper side of the counter-bearing and the underside of the counter-element, which spacing is smaller than the spacing between the card flat clothing and the clothed roller.

* * * * *